US010354630B2

(12) United States Patent
Tabata et al.

(10) Patent No.: US 10,354,630 B2
(45) Date of Patent: Jul. 16, 2019

(54) PERFORMANCE INFORMATION PROCESSING DEVICE AND METHOD

(71) Applicant: YAMAHA CORPORATION, Hamamatsu-shi (JP)

(72) Inventors: Ryo Tabata, Hamamatsu (JP); Jun Usui, Hamamatsu (JP); Emi Tanabe, Hamamatsu (JP); Takahiro Yanagawa, Hamamatsu (JP); Yuji Yamada, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/506,842

(22) PCT Filed: Sep. 18, 2015

(86) PCT No.: PCT/JP2015/076763
§ 371 (c)(1),
(2) Date: Feb. 27, 2017

(87) PCT Pub. No.: WO2016/052274
PCT Pub. Date: Apr. 7, 2016

(65) Prior Publication Data

US 2017/0278501 A1 Sep. 28, 2017

(30) Foreign Application Priority Data

Sep. 29, 2014 (JP) ..... 2014-198252

(51) Int. Cl.
*G10H 1/36* (2006.01)
*G10H 1/00* (2006.01)
*G10H 3/18* (2006.01)

(52) U.S. Cl.
CPC ..... *G10H 1/361* (2013.01); *G10H 1/0033* (2013.01); *G10H 3/186* (2013.01);
(Continued)

(58) Field of Classification Search
CPC ..... G10H 1/361; G10H 1/0033
(Continued)

(56) References Cited

U.S. PATENT DOCUMENTS 4,339,980 A * 7/1982 Hooke ..... G10H 1/0033 360/12
5,399,799 A * 3/1995 Gabriel ..... G10H 1/0033 84/609

(Continued)

FOREIGN PATENT DOCUMENTS

JP 11327550 A * 11/1999
JP 11327550 A * 11/1999

(Continued)

OTHER PUBLICATIONS

International Search Report issued in Intl. Appln. No. PCT/JP2015/076763 dated Dec. 15, 2015. English translation provided.

(Continued)

*Primary Examiner* — David S Warren
*Assistant Examiner* — Christina M Schreiber
(74) *Attorney, Agent, or Firm* — Rossi, Kimms & McDowell LLP

(57) ABSTRACT

Performance information of a music performance executed by a user is received, and temporarily stored into a buffer for each given time period. The performance information is recorded into a recording section in response to a recording instruction by the user. Second performance information having a definite time period is reproduced repeatedly, and the user ad-libs a desired musical performance while listening to the repeatedly reproduced tones of the second performance information. The given time period is set to coincide with the definite time period of the second performance information. Temporarily-stored performance information for the given time period is recorded in one of a (Continued)

plurality of recording tracks. In response to a plurality of user's recording instructions, a plurality of different segments of performance information for the given time period are recorded into respective ones of the recording tracks, and these different segments are reproduced repeatedly in synchronized fashion.

6 Claims, 4 Drawing Sheets

(52) U.S. Cl.
CPC . *G10H 2210/005* (2013.01); *G10H 2210/125* (2013.01); *G10H 2230/031* (2013.01); *G10H 2250/641* (2013.01)

(58) Field of Classification Search
USPC ..... 84/603
See application file for complete search history.

(56) References Cited

U.S. PATENT DOCUMENTS 5,412,628 A * 5/1995 Yamazaki ..... G11B 7/28 369/30.19
5,499,922 A * 3/1996 Umeda ..... G10H 1/0066 434/307 A
9,165,546 B2 * 10/2015 Setoguchi ..... G06F 17/00
9,286,872 B2 * 3/2016 Packouz ..... G10H 3/186
9,336,764 B2 * 5/2016 Setoguchi ..... G10H 1/42
9,852,216 B2 * 12/2017 Belcher ..... G06F 16/60
2003/0171933 A1 * 9/2003 Perille ..... G10H 1/0033 704/500
2012/0097014 A1 * 4/2012 Matsumoto ..... G10H 1/0033 84/634
2015/0094833 A1 * 4/2015 Clements ..... G06F 3/165 700/94
2017/0256246 A1 * 9/2017 Maezawa ..... G10G 1/00
2017/0278501 A1 * 9/2017 Tabata ..... G10H 1/0033
2019/0057677 A1 * 2/2019 Elson ..... H04N 7/142

FOREIGN PATENT DOCUMENTS

JP H11327550 A 11/1999
JP 2002221964 A 8/2002
JP 2006023569 A 1/2006
JP 4117596 B2 7/2008
JP 2011112679 A 6/2011
JP 2013195772 A 9/2013

OTHER PUBLICATIONS

Written Opinion issued in Intl. Appln. No. PCT/JP2015/076763 dated Dec. 15, 2015.
Extended European Search Report issued in European Appln. No. 15846073.3 dated Feb. 16, 2018.
"RC-300 Loop Station Owner's Manual." Jul. 1, 2012: 1-47. Roland Corporation U.S. Cited in NPL 1.
"KAOSS Pad KP3 Dynamic Effect/Sampler, Owner's Manual." 2006: 75 pages. KORG Inc. Japan. Cited in NPL 1.
Office Action issued in Japanese Application No. 2014-198252 dated Jul. 10, 2018. English translation provided.

* cited by examiner

PERFORMANCE INFORMATION PROCESSING DEVICE AND METHOD

TECHNICAL FIELD

The present invention relates to a performance information processing device and method and more particularly to a technique which allows user-input performance information to be recorded through a simple operation. The present invention also relates to a technique which allows the recorded performance information to be repeatedly reproduced (i.e., loop-reproduced) in synchronism with other performance information.

BACKGROUND ART

Heretofore, there have been known a technique which records new performance information while repeatedly reproducing (i.e., loop-reproducing) existing performance information of an accompaniment or the like. Patent Literature 1 identified below, for example, discloses that a successive accompaniment pattern is reproduced by a plurality of accompaniment elements from an intro pattern to an ending pattern being reproduced sequentially and successively with a single accompaniment element reproduced in a looped fashion as necessary. Patent Literature 1 also discloses that, in response to a user turning on a recording switch and then executing desired performance operations during playback or reproduction of the accompaniment pattern, for example, during reproduction of the intro pattern, input elements based on key events corresponding to the performance operations are recorded into a recording area. The input elements thus recorded in the recording area are merged into a reproduction area of the currently reproduced intro pattern, and upon completion of the reproduction of the intro pattern, the merged input elements are reproduced following the intro pattern. In this way, the accompaniment pattern can be reproduced and recorded with all of the accompaniment elements connected together, and an accompaniment pattern just as imaged by the user can be created with no break in a series of musical connections from the "intro pattern" to the "ending pattern" and with no break in a performance groove or ride.

With the technique disclosed in Patent Literature 1, however, the user cannot create a new accompaniment pattern while listening to a previously-created accompaniment pattern by imparting a user-desired musical modification to the previously-created accompaniment pattern, through repeated trials and errors, to thereby supplement the previously-created accompaniment pattern. Further, in recording a user's performance, the use has to execute desired performance operations after turning on the recording switch, and thus, a not-so-good performance too may be undesirably recorded; that is, recording only a good performance cannot be done with ease.

Patent Literature 2 identified below discloses an automatic performance apparatus which creates an accompaniment pattern imparted with a user-desired musical modification. In this automatic performance apparatus, repeated reproduction is performed for one or more layers having performance events recorded therein among a plurality of layers in a recording area, when the recording switch is not being depressed. However, once the recording switch is depressed, performance events generated in response to user's performance operations are recorded into a layer newly designated by an operation of a layer change switch. In this way, it is possible to execute multiple recording where events generated in response to a performance executed in real time by the user while listening to reproduced sounds or tones of a previously-recorded performance.

PRIOR ART LITERATURE

Patent Literature

Patent Literature 1: Japanese Patent No. 4117596

Patent Literature 2: Japanese Patent Application Laid-open Publication No. 2011-112679

However, according to the technique disclosed in Patent Literature 2, a transition is made to the recording action in response to depression of the recording switch and a transition is made to the reproduction action in response to release of the recording switch. Thus, in recording a performance, it is necessary for the user to intentionally execute a recording start operation and simultaneously execute performance operations. Therefore, even when the user has been able to incidentally play a nice or good phrase (performance phrase) during a free or casual performance, for example, the performance phrase cannot be recorded unless the playing of the nice phrase is after the intentional recording operation has been executed. The technique disclosed in Patent Literature 1 too would present similar problems.

Further, with the technique disclosed in Patent Literature 2, it is necessary for the user to execute troublesome operations of adjusting reproduction timings of the layers (tracks). Thus, the user has to concentrate his or her consciousness or effort on adjustment of the timings for reproducing the recorded performance events, so that the user cannot concentrate on executing a free impromptu or ad-lib performance.

SUMMARY OF INVENTION

In view of the foregoing prior art problems, it is an object of the present invention to allow performance information of a music performance, executed by a user, to be recorded with a simple operation and to allow the recorded performance information to be repeatedly reproduced in synchronism with other performance information.

In order to accomplish the above-mentioned objects, the present invention provides an performance information processing device which comprises: a performance information reception section that receives first performance information of a music performance executed by a user; a reproduction section that repeatedly reproduces second performance information having a given time period; a buffer section that temporarily stores the first performance information for each given time period; a recording instruction section that receives a recording instruction given by the user; and a control section configured to record, in response to the recording instruction, the temporarily-stored first performance information for the given time period into a recording section.

According to the present invention, the user can execute a music performance ad-lib that fits the repeatedly reproduced second performance information while listening to the second performance information. The first performance information of the music performance executed by the user is temporarily stored into the buffer section for each given time period that synchronizes with the repetition of the second performance information, and, in response to a recording instruction given by the user, the temporarily-stored first performance information for the given time period is recorded into the recording section. Therefore, the user can execute a music performance lightheartedly and freely without minding when to give the recording instruction (i.e., when the user should give the recording instruction), and the user may give the recording instruction when the user feels that he or she has been able to play a nice phrase during the course of the lighthearted music performance. Namely, the first performance information for the given time period, which is already temporarily stored in the buffer section when the recording instruction has been given and which was felt by the user as "nice performance", is recorded into the recording section in response to the recording instruction. Thus, according to the present invention, there is no need for the user to simultaneously execute a recording instructing operation and performance operations, and the user only has to execute a recording instructing operation only after he or she has executed performance operations suiting his or her preference or taste; consequently, the performance information of the music performance executed by the user can be recorded with a simple operation. Further, because the given time period of the first performance information to be temporarily stored into the buffer section coincides with the time period of the repeated reproduction of the second performance information, the present invention allows the two performance information (i.e., recorded first performance information and second performance information) to be readily repeatedly reproduced in synchronized relation to each other.

In an embodiment of the invention, the second performance information may be recorded in the recording section, and the reproduction section may repeatedly reproduce the second performance information recorded in the recording section.

In an embodiment of the invention, the performance information processing device may further comprises a recording deletion instructing section that receives a recording deletion instruction given by the user, and the control section may be configured to delete, in response to the recording deletion instruction, the first performance information recorded in the recording section. With such arrangements, the first performance information once recorded in the recording section can be deleted and replaced with other performance information as desired.

In one embodiment of the invention, the control section may be configured to record, in response to one recording instruction, the temporarily stored first performance information for the given time period into any one of a plurality of recording tracks of the recording section, so that, in response to a plurality of such recording instructions, different segments of the first performance information for the given time period are recorded into respective ones of the plurality of recording tracks. The performance information processing device may be constructed in such a manner that the different segments of the first performance information recorded in the plurality of recording tracks are reproduced repeatedly in synchronized relation to each other. With such arrangements, the present invention permits multiple recording of different segments and can enrich the construction of a phrase to be reproduced repeatedly.

The present invention can be practiced also as a performance information processing method, which comprises: a step of receiving first performance information of a music performance executed by a user; a step of repeatedly reproducing second performance information having a given time period; a step of temporarily storing the first performance information for each given time period; a step of receiving a recording instruction given by the user; and a step of recording, in response to the recording instruction, the temporarily-stored first performance information for the given time period into a recording section.

Further, the present invention can be practiced as a non-transitory computer-readable storage medium containing a group of instructions executable by a processor for performing the aforementioned performance information processing method.

DESCRIPTION OF EMBODIMENTS

Figure 1C:
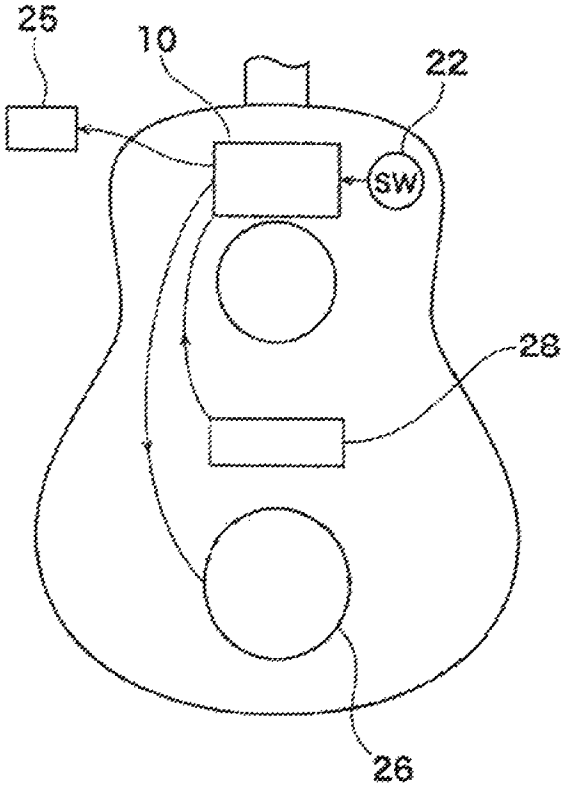
FIG. 1(*a*) is a schematic front view of a performance information processing device according to one embodiment of the present invention constructed as a musical instrument of a guitar type, FIG. 1(*b*) is a side view of the performance information processing device 100, and FIG. 1(*c*) is a sectional view taken along the A-A of FIG. 1(*b*)
Figure 1B:
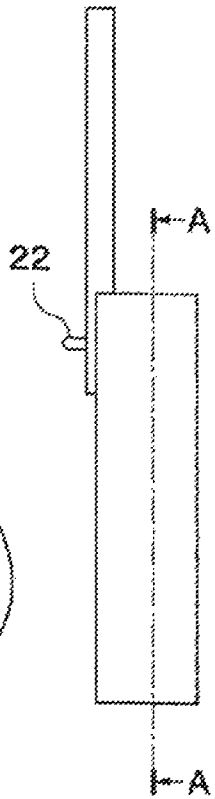
Figure 1A:
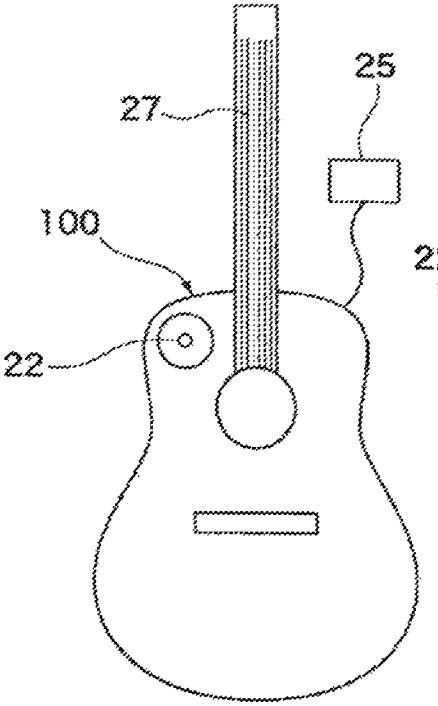

FIG. 1(*a*) is a schematic front view of a performance information processing device according to one embodiment of the present invention. Let it be assumed here that the performance information processing device according to the embodiment of the present invention is incorporated in an acoustic guitar 100. Note, however, that the performance information processing device according to the embodiment of the present invention may be any type of other musical instrument or device where some kinds of performance operations are possible. Further, the performance information processing device according to the embodiment need not necessarily include any particular element(s) called performance operator(s), and the basic principles of the present invention are applicable as long as the performance information processing device is a device where some kinds of performance operations are possible. FIG. 1(*b*) is a side view of the guitar 100, and FIG. 1(*c*) is a sectional view taken along the A-A of FIG. 1(*b*).

The guitar 100 includes performance operators 27 in the form of strings. A control section 10, a pickup 28 and a transducer 26 are provided on the body of the guitar 100. Further, a switch 22 is provided on and projects outward from the soundboard of the guitar body. The pickup 28, transducer 26 and switch 22 are connected to the control section 10. An external speaker 25 is also connected to the control section 10. A non-contact power charging scheme may be employed to supply electric power to the control section 10 etc.

Figure 2:
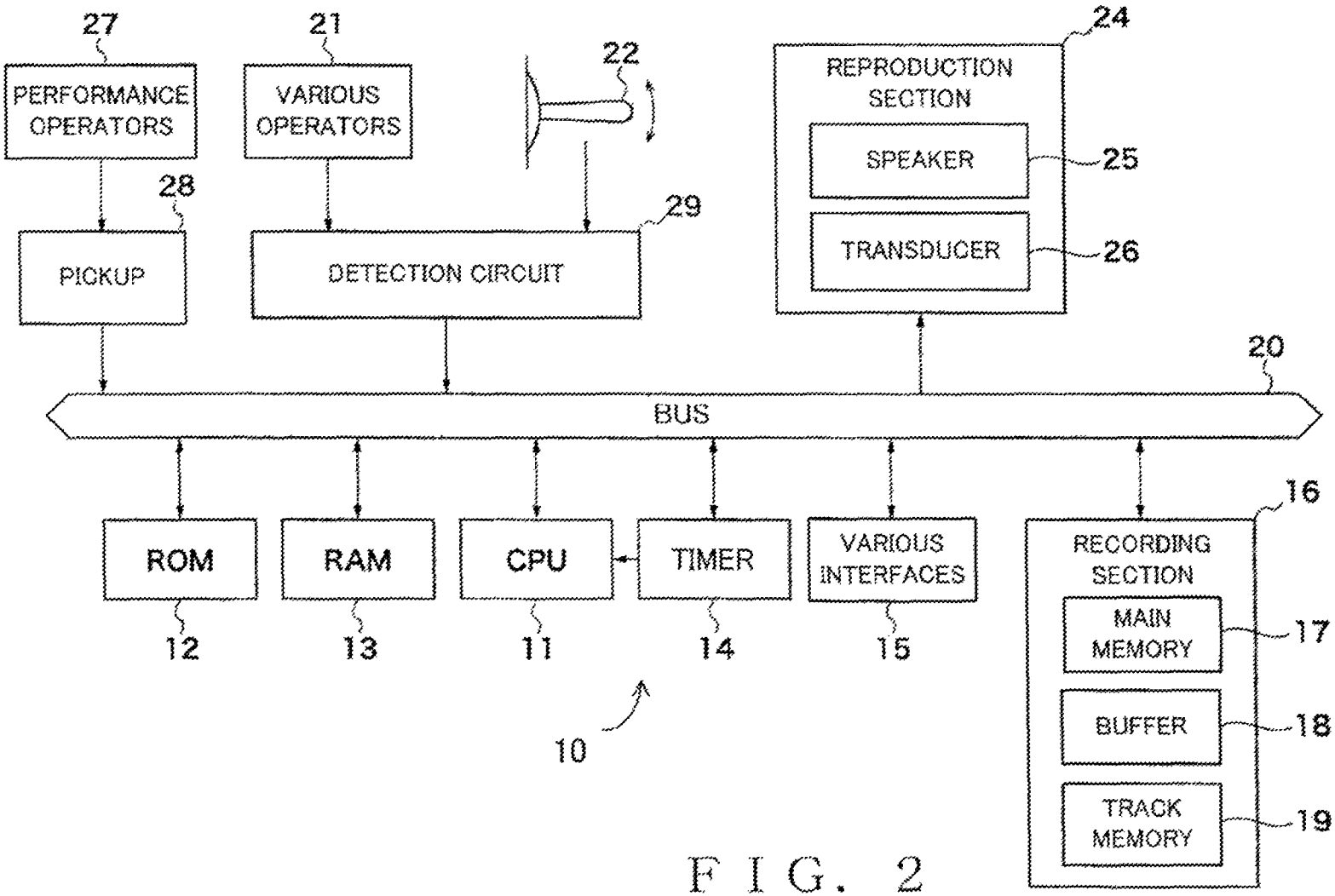
FIG. 2 is a block diagram illustratively showing a control system of the performance information processing device guitar according to the embodiment of the present invention.

FIG. 2 is a block diagram showing a control system of the guitar 100 to which is employed the performance information processing device of the present invention.

In the control section 10 of the guitar 100, a ROM 12, a RAM 13, a timer 14, various interfaces (I/Fs), a recording section 16, the pickup 28, a detection circuit 29 and a reproduction section 24 are connected to a CPU 11 via a bus 20. The switch 22 and various operators 21 are connected to the detection circuit 29. The reproduction section 24 includes the transducer 26 and/or the speaker 25 as an example of a sounding section that generates physical vibration sounds, and the reproduction section 24 has a function to supply an electric audio signal (tone signal) to the sounding section in response to an instruction given from the CPU 11. The reproduction section 24 may include an electronic sound generator circuit and an effect circuit as necessary. The sounding section may be any one of the transducer 26 and the speaker 25. The transducer 26 is a vibrator that vibrates by being driven by the supplied audio signal and thereby vibrates (excites) the sound board for audible generation of a tone. The various I/Fs 15 include a MIDI interface, an interface for inputting tone signals, etc.

The pickup 28, which is provided on the saddle, converts vibration of the performance operators 27 in the form of strings to electrical signals, and the thus-converted electrical signals are supplied to the CPU 11. Even during the vibration by the transducer 26, the pickup 28 can extract a performance by the performance operators 27, so that performance information corresponding to user's performance operations can be acquired. The detection circuit 29 detects operating states of the various operators 21 and the switch 22 and supplies the results of the detection to the CPU 11. As an example, a raised position of the switch 22 is a neutral position of the switch 22, and the user can execute an operation for instructing recording by bringing down the switch 22 in a predetermined direction from the raised position and can execute an operation for deleting a recording by bringing down the switch 22 in another direction opposite the above-mentioned predetermined direction. The switch 22 is normally urged toward the raised position so that it can automatically return to the raised position as the user lets go of his or her hand having executed the bringing-down operation.

The CPU 11 is in charge of control of the entire performance information processing device. The ROM 12 stores control programs to be executed by the CPU 11, various table data, etc. The RAM 13 temporarily stores various information, flags, results of arithmetic operations, etc. The timer 14 counts various times. The recording section 16 includes a main memory 17, a buffer 18, and a track memory 19. A portion of functions of the recording section 16 may be performed by the RAM 13. An application program for implementing the functions of the performance information processing device or method of the present invention is stored in a non-transitory computer-readable storage medium, such as the ROM 12 or the recording section 16, and executed by a processor, such as the CPU 11 or a DSP.

In FIG. 2, the performance operators 27 are provided for the user to execute a desired music performance in real time. The pickup 28 and a construction (interface) for coupling output signals from the pickup 28 to the bus 20 function as a performance information reception section that receives performance information of a music performance executed by the user (first performance information). The buffer 18 functions as a buffer section that temporarily stores the received performance information for each given time period. The switch 22 functions as a recording instruction section that receives a recording instruction given by the user. The CPU 11 functions as a control section for recording the temporarily stored performance information of the given time period into the recording section (track memory 19) in response to the user's recording instruction. Details of the above components will be discussed later with reference to FIGS. 3 and 4.

Figure 3A:
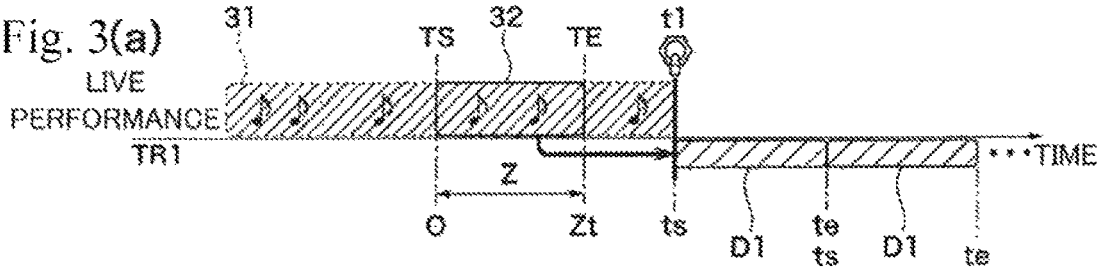
FIGS. 3(*a*), 3(*b*), and 3(*c*) are conceptual diagrams showing a manner in which sectional performance information is acquired and recorded into a track in response to a performance.
Figure 3B:
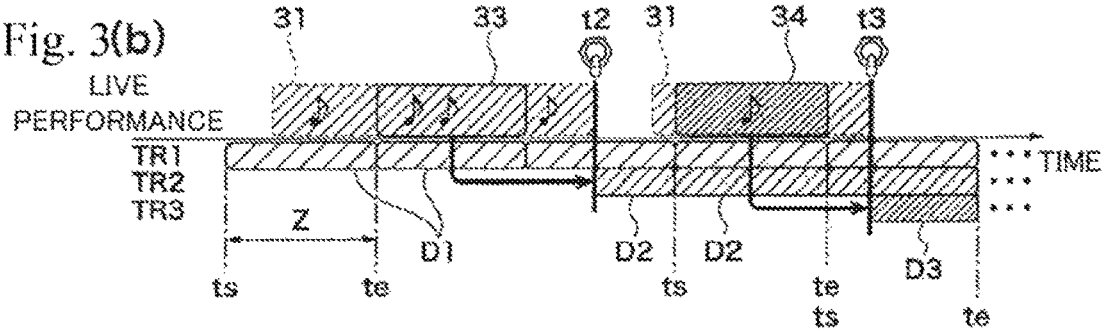
Figure 3C:
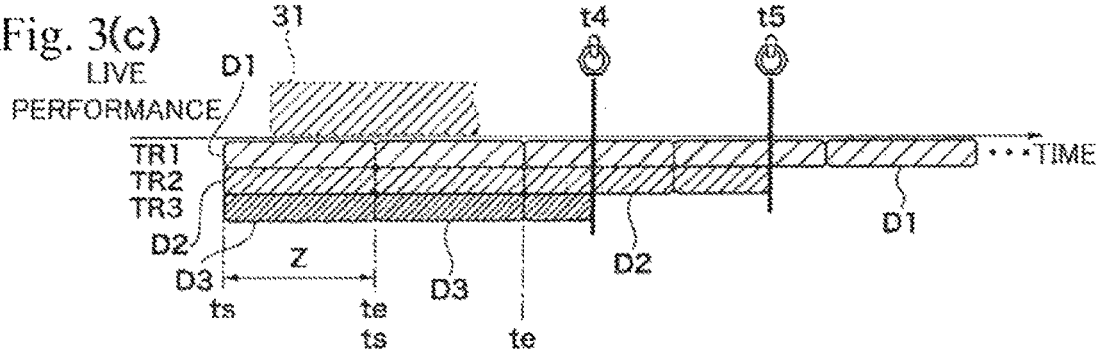

FIGS. 3(*a*) to 3(*c*) are conceptual diagrams showing a manner in which performance information received via the aforementioned performance information reception section (pickup 28 etc.) in response to user's real-time performance operations on the performance operators 27 is recorded onto tracks. In these figures, time is represented on the horizontal axis.

The guitar 100 is constructed to be always kept in a state where a live performance by the user or human player can be recorded successively. Electric power supply to various sections, such as the control section 10, of the device may be effected either by supply of charged electric power or by supply of electric power via a wire. It is desirable that triggering for the start of the performance recording process be interlocked with an operation normally executed for using the guitar 100, such as an operation of detaching the guitar 100 from a guitar stand having a charging function in the case where the electric power is supplied to the various sections by a battery, or an operation of connecting a power supply cord to an outlet in a wall in the case where the electric power is supplied via a wire. As an example, the guitar 100 is placed in the successive recording state in response to turning-on of a not-shown power button included in the various operators 21. Alternatively, the start of the performance recording process may be triggered by detection, by the CPU 11, of a performance operation of any one of the performance operators 27 or a performed tone generated by such a performance operation. As another alternative, a contact sensor and/or acceleration sensor may be provided so that the start of the performance recording process is triggered in response to the human player touching the guitar 100 or detection of an operation for preparing a performance.

Before describing specific processing performed by the CPU 11 with reference to FIG. 4, a rough description will be given, with reference to FIG. 3, about an operational flow in which, of performance information of a music performance executed by the user via the operators 27 (i.e., first performance information), performance information of a particular time period of a music performance is recorded into a track TR. Once the performance recording process is started, the human player (user) freely executes a live performance using the performance operators 27 without minding when to give a recording instruction. Signals detected by the pickup 28 during the live performance are received as performance information 31 by the control section 10 and then recorded successively into the main memory 17 of the recording section 16. Time information (timer value) is associated with the thus-recorded performance information 31 on the basis of the time counting by the timer 14. The recording of the performance information into the main memory 17 is executed in such a manner that new data is always held in the main memory 17 in a FIFO (First-IN First-Out) fashion as in the case of a drive recorder. Namely, after the recorded data quantity of the main memory 17 has reached a predetermined quantity, new data is automatically written over old data. In the illustrated example, the performance information 31 recorded in the main memory 17 is in the form of audio waveform data. This audio waveform data is not necessarily limited to PCM data and may be data compressed in accordance with a suitable compression coding scheme, or data coded in accordance with the MIDI standard or the like.

Further, the performance information 31 recorded in the main memory 17 as above is temporarily stored into the buffer 18 for each given time period. Preferably, the given time period may be a musically-determined time interval or period (e.g., time period of one to four measures). For example, the buffer 18 has a smaller capacity than the main memory 17, and performance information 31 of the latest given time period is transferred from the main memory 17 to the buffer 18 for storage into the buffer 18. Namely, the stored content of the buffer 18 is constantly updated with performance information 31 of the latest given time period.

One example way of determining the aforementioned given time period will be described below with reference to FIG. 3(*a*). Once a first recording instruction is given at a time point t1 of FIG. 3(*a*) by the human player (user) bringing down the switch 22 in the predetermined direction, for example, the CPU 11 automatically determines a performance section Z. In the instant embodiment, a previous predetermined time period is cut out as the performance section Z on the basis of the time point t1 when the recording instruction was given (recording-instruction-given time point t1), although the way of determining the performance section is not so limited. For example, a time period from a time point TS that is five seconds before the recording-instruction-given time point t1 to a time point TE that is one second before the time point t1 is determined as the performance section Z. The performance section Z is determined as the above-mentioned given time period.

In determining the performance section Z, the CPU 11 also extracts, from the recorded performance information 31, performance information 32 corresponding to the determined performance section Z as sectional performance information D1. Also, the CPU 11 sets a threshold value Zt representing the time length of one performance of the sectional performance information D1. More specifically, the threshold value Zt is defined by the time length of the performance section Z. The sectional performance information D1 is recorded into a first track TR1 of the track memory 19 of the recording section 16. When the sectional performance information D1 is stored as above, timer values Tm are associated with the sectional performance information D1 in such a manner that timer values Tm of "0" to "Zt" correspond to the performance section Z.

The sectional performance information D1 starts to be reproduced in a looped fashion (i.e., loop-reproduced) at the time point t1. Namely, the CPU 11 repeatedly reproduces the sectional performance information D1 of the first track TR1 with the performance section A, starting at the time point is and ending at a time point te, as a repetition unit (FIG. 3(*a*)). Reproduced sounds are audibly generated from the sound board of the guitar 100 excited, for example, by the transducer 26 of the reproduction section 24. Thus, when the human player feels that he or she has been able to play a nice phrase while performing the guitar freely or lightheartedly, the human player gives a recording instruction via the switch 22. Thus, the nice phrase having been played a predetermined time ago is stored as the sectional performance information D1, so that the human player can promptly listen to the phrase through the looped reproduction.

As shown in FIG. 3(*b*), the recording, into the main memory 17, of the performance information 31 responsive to the live performance is continued in parallel with the performance of the first track TR1, i.e. the looped reproduction of the sectional performance information D1. During that time, the performance information 31 is acquired repeatedly as sectional performance information 33, i.e. once per given time period synchronous with the performance section Z of the sectional performance information D1 that is reproduced repeatedly, and then stored into the buffer 18 of the recording section 16. The sectional performance information 33 thus stored in the buffer 18 is overwritten with new sectional performance information 33 once such new sectional performance information 33 is acquired in response to the next looped reproduction. Thus, in the buffer 18 is constantly stored sectional performance information 33 of the latest given time period acquired in response to the last looped reproduction that immediately precedes the current looped reproduction.

While listening to loop-reproduced tones of the sectional performance information D1 that is the first phrase, the human player can play, through trials and errors phrases to be superimposed on the first phrase. During that time too, when the human player feels the human player has been able to play a performance phrase he or she likes (i.e., suiting his or her taste), the human player can give a recording instruction via the switch 22. For example, when the human player gives a recording instruction at a time point t2, sectional performance information of the latest given time period, currently stored in the buffer 18, is recorded as sectional performance information D2 into the second track TR2 of the track memory 19 of the recording section 16 in temporal association with the sectional performance information D1. The sectional performance information D1 and the sectional performance information D2 are identical to each other in the performance section Z; that is, the threshold value Zt representing the time length of one performance of the sectional performance information D2 is identical to that of the sectional performance information D1. When the sectional performance information D2 or other sectional performance information D following the sectional performance information D2 is stored, too, timer values Tm are associated with the sectional performance information D in such a manner that timer values Tm from "0" to "Zt" correspond to the performance section Z.

From the time point t2 when the recording instruction t2 has been given during the looped reproduction, the sectional performance information D1 and the newly recorded sectional performance information D2 are loop-reproduced in a synchronized and superimposed fashion. Namely, the CPU 11 controls the recording section 16 and the reproduction section 24 to repeatedly execute synchronized reproduction of the sectional performance information D1 and D2 having, as the repetition unit, the performance section Z starting at the time point is and ending at the time point to (FIG. 3(*b*)).

Here, a process in the synchronized reproduction of the sectional performance information D1 and D2 may be considered to be similar to the aforementioned process, provided that the sectional performance information D1 and D2 is regarded as the aforementioned sectional performance information D1 and newly acquired sectional performance information D3 is regarded as the sectional performance information D2. Thus, once a recording instruction is given at a time point t3 during the synchronized reproduction of the sectional performance information D1 and D2, the latest sectional performance information 34 is recorded as sectional performance information D3 into the third track TR3 of the track memory 19 of the recording section 16 in temporal association with the sectional performance information D1 and D2. Then, from the time point t3, the sectional performance information D1 and D2 and the newly recorded sectional performance information D3 is loop-reproduced in a synchronized and superimposed fashion (FIG. 3(*b*)).

Although FIG. 3(*b*) shows only three tracks TR, the number of the tracks TR is not limited to three. The number of the sectional performance information D can increase to more than three as the aforementioned process is repeated, in response to which the number of the tracks TR to be reproduced in a synchronized fashion can also increase.

By the way, sometimes, the human player may sometimes want to delete a once-recorded track TR (sectional performance information D), for example, due to a reason that he or she does not like the recorded performance after all. Thus, in the instant embodiment, the human player is allowed to delete the latest track TR by executing a deletion instructing operation via the switch 22, as shown in FIG. 3(*c*).

For example, once a deletion instruction is given at a time point t4 during the synchronized looped reproduction of the sectional performance information D1, D2 and D3, the third track TR3 (sectional performance information D3) that is the latest track is deleted. Then, following the time point t4, the reproduction of only the sectional performance information D3 is terminated with the synchronized looped reproduction of the sectional performance information D1 and D2 still continued. Further, once a deletion instruction is given at a time point t5 during the synchronized looped reproduction of the sectional performance information D1 and D2, the second track TR2 (sectional performance information D2) that is the latest track is deleted. Then, following the time point t5, only the reproduction of the sectional performance information D2 is terminated with the looped reproduction of the sectional performance information D1 still continued. If a further deletion instruction is given during the looped reproduction of the sectional performance information D1, the first track TR1 (sectional performance information D1) too is deleted, so that the guitar 100 returns to an initial performance start state as depicted at a left end portion of FIG. 3(*a*).

Figure 4:
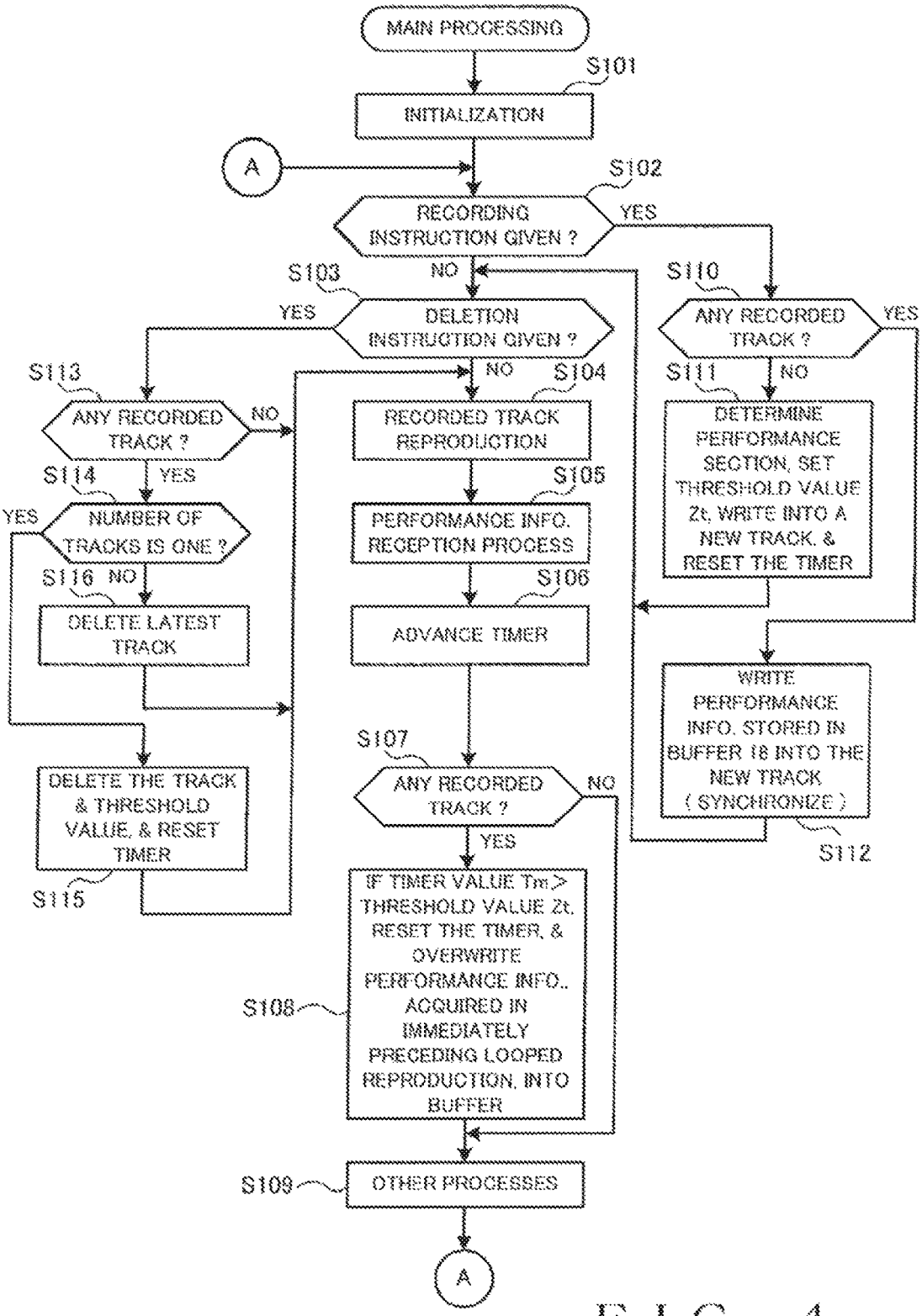
FIG. 4 is a flow chart illustratively showing main processing performed in the performance information processing device guitar according to the embodiment of the present invention.

FIG. 4 is a flow chart showing main processing performed by the CPU 11. This main processing is started up in response to detection of an operation that triggers the start of the performance recording process. First, the CPU 11 executes an initialization process (step S101). Namely, in the initialization process, the CPU 11 starts execution of a predetermined program, resets the timer value Tm counted by the timer 14, and resets the main memory 17, the buffer 18, the track memory 19, etc.

Then, the CPU 11 determines whether a recording instruction has been given by the switch 22 being operated in the predetermined direction (step S102). If there has been given no recording instruction as determined at step S102, the CPU 11 determines whether a deletion instruction has been given by the switch 22 being operated in another predetermined direction (step S103). If there has been given no deletion instruction as determined at step S103, the CPU 11 proceeds to step S104.

At step S104, if there is any track TR having performance information recorded therein, the CPU 11 repeatedly reproduces the performance information recorded in that track TR. Namely, the CPU 11 reproduces information corresponding to the current timer value Tm from the sectional performance information D recorded in the track TR. In the illustrated example of FIG. 3(*b*), for instance, the sectional performance information D1 recorded in the first track TR1 is reproduced. If there are a plurality of tracks TR having performance information recorded therein, information corresponding to the current timer value Tm in all of the sectional performance information D recorded in the plurality of tracks TR is repeatedly reproduced in a synchronized fashion. Thus, the repeated reproduction is synchronized on the basis of the timer value Tm (see, for example, a left half portion of FIG. 3(*c*)). Note that no reproduction is executed if there is no track having performance information recorded therein.

Then, the CPU 11 executes a performance information reception process (step S105). Namely, the CPU 11 receives performance information 31 detected and obtained via the pickup 28 during a live performance and records the received performance information into the main memory 17. The current timer value Tm is associated with the performance information 31 recorded into the main memory 17. After that, the CPU 11 advances the time counting by the timer 14 to update the timer value Tm (step S106) and determines whether there is any track TR having performance information recorded therein (step S107).

The CPU 11 goes to step S109 if there is no track having performance information recorded therein as determined at step S107, but it goes to step S108 if there is any track having performance information recorded therein as determined at step S107. At step S108, the CPU 11 compares the current timer value Tm and the threshold value Zt of the performance section Z of the sectional performance information D. Once the timer value Tm exceeds the threshold value Zt (i.e., once a condition of the timer value Tm>the threshold value Zt is established), the CPU 11 overwrites the sectional performance information 33 (or sectional performance information 34), acquired in the immediately preceding looped reproduction, into the buffer 18 of the recording section 16 and resets the timer value Tm. By the time value Tm being reset like this, the performance section Z will be reproduced repeatedly. If the timer value Tm≤the threshold value Zt, neither the resetting of the timer value Tm nor the overwriting into the buffer 18 is executed. The CPU 11 proceeds to step S109 following step S108.

The CPU 11 executes other processes at step S109 and then reverts to step S102. The "other processes" include a process for audibly generating performed tones, processes corresponding to the operators 21 (such as a process for exporting data of a selected track TR), etc.

If a recording instruction has been given by the user as determined at step S102, the CPU 11 further determines whether there is any track TR having performance information recorded therein (step S110). Then, the CPU 11 goes to step S111 if there is no track TR having performance information recorded therein as determined at step S110, but it goes to step S112 if there is any track TR having performance information recorded therein.

At step S111, the CPU 11 identifies the sectional performance information D1 and records the identified sectional performance information D1. More specifically, at step S111, the CPU 11 determines the performance section Z on the basis of the time point when the recording instruction has been given (e.g., time point t1 in FIG. 3(*a*), and sets the threshold value Zt. Also, the CPU 11 records (writes), as the sectional performance information D1, performance information 32, included in the performance information 31 of the live performance and corresponding to the performance section Z, into the first track TR1 of the track memory 19 of the recording section 16 (see a right half portion of FIG. 3(*a*)). Further, the CPU 11 resets the timer value Tm counted by the timer 14 and then proceeds to step S103.

At step S112, the CPU 11 records, into a new track TR, performance information (performance information of the latest given time period) being temporarily stored in the buffer 18 at the time point when the recording instruction has been given. Namely, stored content of the buffer 18 at the time point when the recording instruction has been given (e.g., sectional performance information 33 in FIG. 3(*b*)) is recorded into a new track (second track TR2) of the track memory 19 of the recording section 16 as new sectional performance information D (sectional performance information D2) in temporal association with the existing sectional performance information D (sectional performance information D1). Thus, the new sectional performance information D is written into the new track TR in such a manner as to synchronize with the sectional performance information D of the existing track TR. Therefore, the human player can freely execute performance operations without particularly minding when to give a recording instruction; thus, it is only necessary for the human player to execute a recording instructing operation when the human player feels that he or she has been able to execute a performance operation he or she likes. After that, the CPU 11 goes to step S103.

If a deletion instruction has been given as determined at step S103, the CPU 11 further determines whether there is any track TR having performance information recorded therein (step S113). If there is no track TR having performance information recorded therein, the CPU 11 proceeds to step S104. If there is any track TR having performance information recorded therein, on the other hand, the CPU 11 further determines whether the number of such a recorded track TR is one (step S114).

If the number of the recorded tracks TR is one as determined at step S114, that recorded is the first track TR1. Thus, at step S115, the CPU 11 deletes the sectional performance information D1 corresponding to the first track TR1. Also, the CPU 11 deletes the threshold value Zt, but also resets the timer value Tm counted by the timer 14. After that, the CPU 11 proceeds to step S104.

If the number of the recorded tracks TR two or more as determined at step S114, on the other hand, the CPU 11 goes to step S116, where it deletes the latest one of the recorded tracks TR together with the sectional performance information D corresponding to the latest recorded track TR. When a deletion instruction has been given at the time point t4 (or time point t5) in the illustrated example of FIG. 3(*c*), for instance, the third track TR3 (or second track TR2) that is the latest track is deleted. After which the CPU goes to step S104.

When the sectional performance information D has been recorded into the new track TR at step S112, the timer value Tm becomes equal to or smaller than the threshold value Zt (Tm ≤Zt) at immediately following step S108 because the timer value Tm normally indicates a halfway value of the performance section Z. Thus, as indicated at time points t2 and t3 in FIG. 3(*b*), the sectional performance information D of the new track TR starts to be reproduced promptly at a halfway position of the performance section Z. Note, however, such arrangements are not necessarily essential, and the reproduction of the next performance section Z may be started at the beginning of the performance section Z (after the timer value Tm reaches the threshold value Zt). In the illustrated example of FIG. 3(*b*), control may be performed such that, for the new or second track TR2, no reproduction is executed from time point t2 to time point is immediately following time point t2.

Similarly to the above, in the case where a deletion instruction has been given, the track TR and the corresponding sectional performance information D may be deleted after the reproduction of the sectional performance information D being reproduced at the time point when the deletion instruction has been given (e.g., the timer value Tm reaches the threshold value Zt) is terminated, rather than deleted immediately. Note that the way of associating the time information of the sectional performance information D with the performance section Z in the process of FIG. 4 is not necessarily limited to the aforementioned.

According to the instant embodiment, in the state where there is sectional performance information D1 whose performance section Z has been determined (FIG. 3(*b*)), once the human player gives a recording instruction while executing a performance in parallel with the looped reproduction of the sectional performance information D1, the latest sectional performance information 33 is recorded into the second track TR2 as sectional performance information D2 in temporal association with the sectional performance information D1. Then, the CPU 11 loop-reproduces the sectional performance information D1 and the sectional performance information D2 in a superimposed synchronized fashion.

Namely, by the human player giving a recording instruction at a desired timing while repeating a performance in superimposed relation to the first-recorded phrase, not only the performance immediately preceding the timing of the recording instruction can be recorded in synchronism with the first-recorded phrase, but also these performances can be loop-reproduced in a synchronized fashion. Besides, because there is no need for the human player to give a recording instruction prior to or simultaneously with the start of performance operations, the human player can execute an ad-lib performance in a natural manner without having to mind a state of recording, and thus, when the human play has been able to execute a performance suiting his or her taste, he or she only has to give a recording instruction following that performance. Thus, when the human play has been able to play a nice phrase while freely or light-heartedly performing the guitar, he or she can record the performance phrase by merely executing a recording instructing operation via the switch 22.

Further, by starting the synchronized reproduction at the time point when the recording instruction has been given, the phrase to be superimposed can be confirmed promptly. Furthermore, even when the number of the already-recorded tracks has become plural, temporal synchronization between the plurality of recorded sectional performance information D can be secured automatically, and thus, the human player can avoid troublesome operations of adjusting the respective reproduction timing for achieving the synchronized reproduction.

Furthermore, when the human player has become no longer satisfied with a recorded phrase after recording the phrase, he or she can delete the latest phrase by executing a deleting operation via the switch 22. Namely, the human player can cancel the recording or storage of the once-superimposed performance. Even at that time, only the latest sectional performance information D is deleted with the looped-reproduction continuing for the remaining sectional performance information D, so that the human player can promptly return to a situation where he or she is allowed to re-execute a superimposed performance etc.

Further, the instant embodiment has been described above in relation to the case where, before sectional performance information D1 exists (FIG. 3(*a*)), sectional performance information D1 is acquired in response to a recording instruction during successive recording of performance information 31 using the main memory 17. In this way, sectional performance information D1 can be acquired at desired timing from an immediately-preceding performance.

Furthermore, because the recording instruction and the deletion instruction can be executed by merely operating the same switch 22 in different operating directions, a construction and operation related to such instructions can be significantly simplified and facilitated. Needless to say, different operators, rather than the same switch 22, may be provided for giving the recording instruction and the deletion instruction.

The instant embodiment has been described above as constructed in such a manner that no sectional performance information D1 exists immediately after the performance recording process on the guitar 100 is started. However, the present invention is not so limited, and some sectional performance information D1 whose performance section Z has been determined may be stored in advance in the ROM 12 or the like, and such prestored sectional performance information D1 may be used by being read out and recorded into the first track TR1 as necessary. However, such sectional performance information D1 may be acquired through any desired acquisition channel; for example, the sectional performance information D1 may be acquired from the outside via any one of the various I/Fs 15 without being stored in advance in the ROM 12 or the like.

The construction for generating tones by repeatedly reading out sectional performance information D1, having a determined performance section Z and recorded in the first track TR1, via the reproduction section 24 in the above-described embodiment functions as a reproduction section that repeatedly reproduces second performance information having the given time period (i.e., sectional performance information D1). Namely, the given time period for temporarily storing the first performance information, corresponding to user's performance operations, for each given time period is set to coincide with a definite time period in the repeated reproduction of the second performance information (sectional performance information D1).

Further, in the case where the human player executes a performance in superimposed relation to existing sectional performance information D1 and synchronizes the new performance with the existing sectional performance information D1, the existing sectional performance information D1 may comprising a plurality of synchronized sectional performance information. As noted earlier, if sectional performance information D and D2 corresponds to the existing sectional performance information D1, and sectional performance information D3 to be superimposed on those sectional performance information corresponds to sectional performance information D2. Also note that the total number of the sectional performance information to be superimposed on one another is not necessarily limited to just three and may be four or more; in this way, multiple recording of a multiplicity of phrases is permitted.

Namely, the control section 10 is configured to record, in response to one recording instruction, the temporarily-stored first performance information for the given time period into any one of the plurality of recording tracks of the recording section 16 (track memory 19). In this way, different segments (such as sectional performance information D2 and D3) of the first performance information for the given time period are recorded into respective ones of the plurality of recording tracks in response to a plurality of the recording instructions, and the different segments (such as sectional performance information D2 and D3) of the performance information thus recorded in the respective recording tracks are repeatedly reproduced in a synchronized fashion.

Note that, whereas the strings and the pickup 28 of the guitar 100 have been illustratively described as the constituent elements for detecting a music performance executed by the user, any other desired suitable constituent elements may be employed depending on the musical instrument or device to which the basic principles of the present invention are applied. The constituent elements for detecting a music performance executed by the user may be any other sensors, microphone, etc. as long as they can detect performance operations on the performance operators and collect performed tones generated by the performance. For example, in the case where the musical instrument to which the basic principles of the present invention are applied is a drum or the like, the constituent elements may be a drum trigger, a piezo sensor, etc. Note that the basic principles of the present invention are also applicable to an electronic musical instrument, in which case the electronic musical instrument may be constructed to receive and record performance control signals corresponding to performance operations. The pickup etc. are advantageous over the microphone in that they are less likely to pick up ambient noise and voice, reproduced sound, etc. and thus can effectively acquire only performed tones.

Note that the "music performance executed by the user" that becomes an object of detection and recording is not necessarily limited to human player's performance actions on the performance operators and may include all actions and events intended for generation of tones. Thus, the term "performance" used in the context of the present invention also refers to actions of generating voices (e.g., singing a song) and clapping hands without being limited to an action of playing a musical instrument; more broadly speaking, the "performance" is a concept that embraces all events where sounds are generated.

For example, in the case where a live performance is recorded into the main memory 17 as performance information 31, arrangements may be made such that the human player can execute a performance in accordance with metronome sounds with a performance tempo and time determined in advance. In such a case, the performance section Z can be cut out on the basis of the performance tempo and time. Furthermore, whereas the instant embodiment has been described above in relation to the case where a predetermined time period determined on the basis of a time point when a recording instruction has been given is cut out for determination of the performance section Z in the first sectional performance information D1, the present invention is not so limited. For example, any of the conventionally-known musical information search techniques may be used to detect a boundary of a performance phrase to thereby determine the performance section Z. As an example, there may be employed an approach where a portion of a music performance from a time point when a volume of a performed tone exceeds a threshold value to a time point when the volume falls below the threshold value again is detected as one performance phrase and the latest performance phrase detected in this manner is extracted as the first sectional performance information D1. Alternatively, any of the conventionally-known automatic beat detection techniques may be used to cut out the performance section Z on the basis of a beat and a measure.

Further, in the above-described embodiment, the first sectional performance information D1 to be recorded into the first track TR1 is not temporarily stored into the buffer 18. However, the present invention is not so limited, and the first sectional performance information D1 to be recorded into the first track TR1 may be temporarily stored into the buffer 18. In such a case, before the first performance information (e.g., sectional performance information D1) is recorded into the first track TR1, the length of the given time period of performance information to be temporarily stored into the buffer 18 may differ from one performance information to another; for example, the time period of performance information of one phrase first received and temporarily stored into the buffer 18 in response to a user's performance may be Zt1, the time period of performance information of another phrase next received and temporarily stored into the buffer 18 in response to the user's performance may be Zt2, the time period of performance information of still another phrase subsequently received and temporarily stored into the buffer 18 in response to the user's performance may be Zt3, and so on. If the phrase of the third time period Zt3 is a phrase preferred by the user, the user may give a recording instruction at that time. In response to such a recording instruction, the performance information of the third time period Zt3 is transferred from the buffer 18 to the first track TR1 of the track memory 19 and recorded into the first track TR1. After that, the length of the given time period of performance information to be temporarily stored into the buffer 18 is set to coincide with the time period Zt3 of the performance information thus recorded in the first track TR1.

Also note that arrangements may be made such that the time (time point TS and time point 1B) and time length (threshold value Zt) of the performance section Z can be finely adjusted by user's operations after the determination of the performance section Z. For example, a dial with a click device may be provided so that the time or time length of the performance section Z can change by one beat or one measure per click.

Further, whereas the embodiment has been described above in relation to the case where only the latest track TR is deleted in response to a deleting operation via the switch 22, an operator may be provided which is operable to collectively delete all of the tracks TR. Alternatively, an operator operable to group a plurality of tracks TR into one track TR may be provided. Either or both of the above-mentioned operator operable to collectively delete all of the tracks TR and the operator operable to group a plurality of tracks TR into one track TR may be implemented by another operator than the switch 22, or may be implemented by operating the switch 22 in different manners than the manners in which the switch 22 is operated at the time of the recording and the deleting. For example, the operation for collectively deleting the tracks TR and/or the operation for grouping the plurality of tracks TR into one track TR may be executed by the same operator (e.g., switch 22) being held down and/or depressed for a relatively long time or operated successively a plurality of times at short intervals.

Further, the aforementioned sounding section may comprise an internal speaker or a headphone set rather than the transducer 26 and the external speaker 25. In the case of a musical instrument having a resonance box (sounding box), such as an acoustic guitar, it is highly advantageous to provide the transducer 26 in the sounding section, because, by the transducer vibrating the resonance box, audio as reproduced tones is generated from the body of the musical instrument so that a feeling of unity between the reproduced tones and performed tones can be increased.

Further, in the present invention, the sectional performance information D to be reproduced may be reproduced after being processed in accordance with a predetermined rule, instead of being reproduced as-is. For example, where reproduction speed of the sectional performance information D is to be changed, the sectional performance information D is reproduced after being subjected to a temporal stretch or compression process such that the reproduction speed of the sectional performance information D can be changed accordingly. Where volume of the sectional performance information D is to be changed, the overall volume difference is decreased, for example, by a compressor. Further, an acoustic effect, such as a reverberation, may be imparted to the sectional performance information D. In the case where the reproduction speed of the sectional performance information D is changed by processing the sectional performance information D as noted above, the timer is managed in such a manner as to, for example, associate timer values Tm with the sectional performance information D in accordance with the reproduction speed change so that synchronism can be secured between the sectional performance information D and subsequently recorded sectional performance information D. Note that the above-mentioned processing according to the predetermined rule may be carried out in a predetermined manner or in a manner adjustable as appropriate by the user.

It should also be appreciated that the same advantageous results as the above-described may be achieved by supplying a system or device with a storage medium storing software control programs for implementing the present invention so that a computer (or CPU, MPU or the like) of the system or device reads out the program codes stored in the storage medium. In such a case, the program codes read out from the storage medium themselves implement or realize the novel functions of the present invention, and thus, the storage medium storing the program codes constitutes the present invention. Alternatively, such program codes may be supplied via a transmission medium etc., in which case the program codes themselves constitute the present invention. Alternatively, such program codes may be downloaded via a network.

Whereas the present invention has so far been described on the basis of its preferred embodiments, it should be appreciated that the present invention is not limited to such particular embodiments and embraces various other forms without departing from the gist and spirit of the invention.

The invention claimed is:

1. A performance information processing device comprising:

a performance information reception section that receives live first performance information of a music performance executed by a user;

a reproduction section that repeatedly reproduces recorded second performance information having a given time period;

a buffer section that temporarily and continuously stores a segment of the live first performance information;

a recording instruction section that receives a recording instruction given by the user for recording a segment, having a time length same as the given time period of the recorded second performance information, of the temporarily stored segment of the live first performance information; and a control section configured to instantaneously record, in response to the recording instruction, the entire segment, having the time length same as the given time period, of the temporarily-stored segment of the live first performance information that was already completed, into a recording section as recorded third performance information, wherein the reproduction section further repeatedly reproduces the recorded third performance information in synchronism with repeated reproduction of the recorded second performance information that was recorded before the recorded third performance information.

2. The performance information processing device as claimed in claim 1, wherein the control section records, into the recording section, the entire segment of the temporarily-stored segment of the live first performance information of a latest time period, which is equivalent to the given time period.

3. The performance information processing device as claimed in claim 1, further comprising:

a recording deletion instructing section that receives a recording deletion instruction given by the user, wherein the control section deletes, in response to the recording deletion instruction, the third performance information from the recording section.

4. The performance information processing device as claimed in claim 3, wherein:

the recording section has a plurality of recording tracks, the control section is configured to record, in response to the recording instruction, the third performance information, which has the time length same as the given time period, into any one of the plurality of recording tracks, so that, in response to a plurality of recording instructions, different segments of the temporarily-stored segment of the live first performance information, each having the time length same as the given time period, are each recorded into one of the plurality of recording tracks, and the reproducing section reproduces the different segments of the temporarily-stored segment of the live first performance information recorded into the plurality of recording tracks repeatedly in synchronized relation to each other.

5. A performance information processing method comprising the steps of:

receiving live first performance information of a music performance executed by a user;

repeatedly reproducing recorded second performance information having a given time period;

temporarily and continuously storing, in a buffer section, a segment of the live first performance information;

receiving a recording instruction given by the user for recording a segment, having a time length same as the given time period of the recorded second performance information, of the temporarily stored segment of the live first performance information;

instantaneously recording, in response to the recording instruction, the entire segment, having the time length same as the given time period, of the temporarily-stored segment of the live first performance information that was already completed, into a recording section as recorded third performance information; and repeatedly reproducing the recorded third performance information in synchronism with repeated reproduction of the recorded second performance information that was recorded before the recorded third performance information.

6. A non-transitory computable-readable storage medium containing instructions executable by a processor to perform a performance information processing method comprising:

receiving live first performance information of a music performance executed by a user;

repeatedly reproducing recorded second performance information having a given time period;

temporarily and continuously storing, in a buffer section, a segment of the live first performance information;

receiving a recording instruction given by the user for recording a segment, having a time length same as the given time period of the recorded second performance information, of the temporarily stored segment of the live first performance information;

instantaneously recording, in response to the recording instruction, the entire segment, having the time length same as the given time period, of the temporarily-stored segment of the live first performance information that was already completed, into a recording section as recorded third performance information; and repeatedly reproducing the recorded third performance information in synchronism with repeated reproduction of the recorded second performance information that was recorded before the recorded third performance information.

* * * * *